US005937946A

United States Patent [19]

Streetman

[11] Patent Number: 5,937,946

[45] Date of Patent: Aug. 17, 1999

[54] APPARATUS AND METHOD FOR ENHANCING FLUID AND GAS FLOW IN A WELL

[76] Inventor: Foy Streetman, 401 Chickasha Ave., Chickasha, Okla. 73023

[21] Appl. No.: 09/057,039

[22] Filed: Apr. 8, 1998

[51] Int. Cl.[6] ..... E21B 43/00

[52] U.S. Cl. ..... 166/267; 166/53

[58] Field of Search ..... 166/267, 265, 166/53

[56] References Cited

U.S. PATENT DOCUMENTS

| | | | |
|---|---|---|---|
| 3,678,997 | 7/1972 | Barchard | 166/53 |
| 3,863,714 | 2/1975 | Watson, Jr. | 166/53 |
| 4,226,284 | 10/1980 | Evans | 166/64 |
| 5,082,492 | 1/1992 | Gallup et al. | 75/712 |
| 5,636,693 | 6/1997 | Elmer | 166/370 |

*Primary Examiner*—William Neuder
*Assistant Examiner*—Zakiya Walker
*Attorney, Agent, or Firm*—R. William Graham

[57] ABSTRACT

An apparatus for enhancing fluid and gas flow in a recovery includes an upstream flow line communicably connected at one end to the well in a manner to receive fluid and gas therefrom, a fluid and gas separator communicably connected to another end of the upstream flow line in a manner to receive fluid and gas flow therefrom, a downstream sales flow line communicably connected to the fluid and gas separator in a manner to receive gas flow therefrom and having a restricted region therein, a pressure differential control operably disposed in the downstream sales line for comparatively sensing pressure differential in the downstream sales line about the restricted region, and a control valve operably disposed in the upstream flow line and operably controllably connected to the pressure differential control in a manner to permit regulated flow through the upstream flow line at a predetermined amount in response to the sensed pressure differential. A method is also provided.

11 Claims, 1 Drawing Sheet

APPARATUS AND METHOD FOR ENHANCING FLUID AND GAS FLOW IN A WELL

BACKGROUND OF THE INVENTION

1. Field of the Invention

This invention relates to enhanced recovery from a well. More specifically, this invention relates to an improved apparatus that enhances recovery in oil and gas wells by employing regulated flow devices and techniques and optionally in combination the addition of fluid enhancing additives.

2. Related Art

Each well has its own predetermined optimal recovery conditions which are determined by the natural geological formation of the well. When a successful well is drilled, there is commonly enough gas-volume to fluid-ratio and bottom hole pressure to create a natural flow from the well. This ability to flow at a certain velocity to insure fluids are lifted is termed "critical flow rate." The ability to substantially maintain or simulate natural flow conditions is critical in optimizing recovery.

Under the natural flow pressure, fluid flow is created by virtue of the liquid being broken up into small units by gas existing therein and is carried to the surface due to a fluid "lightening" effect under gaseous expansion to achieve critical flow rate. The combined gas and liquid are transferred via an upstream flow line to a fluid/gas separator which is designed to remove the liquid into storage tanks and remove the gas to a downstream sales flow line which commonly connects with a utility service provider at what is more commonly referred to as the pipeline.

Unfortunately, new tight gas sand wells or older wells having reduced reserve volumes, and pressure in the well depletes during the flow cycle and negatively impacts the optimal recovery conditions and flow needed to achieve critical flow rates. As a result, typically only part of the oil and gas contained in the underground formation by a primary recovery method which uses the natural flow force present in the reservoir is possible. A variety of enhanced recovery techniques such as artificial lift systems, so-called secondary or tertiary recovery methods, have been employed to increase the recovery of oil and gas from subterranean reservoirs.

A common artificial lift, secondary recovery method includes a combination of shutting in the well for a period of time to allow for pressure build up and allowing a plunger to drop to the bottom of the well and then opening the well causing the plunger to drive the fluid to the surface. Another such enhanced recovery technique is to use a pump truck to pump additives into the oil well-bore. These additives can, for example, reduce scale, paraffine and the viscosity of the oil and increase production of oil recovery.

A problem with these prior techniques is the lack of proper control in order to carry out those techniques during initiation and slow down of flow within a well. Also, waste can occur downstream in that metering devices of service providers to which the downstream sales flow line connect do not properly meter or record spikes (temporary large amounts of gas over that recordable by the meter) which occur during the other recovery methods. In this regard, care must be taken to maintain optimal recovery conditions in carrying out other recovery methods.

Though these techniques have been somewhat effective in enhancing recovery, they are not as efficient or cost effective as are now possible with the present invention. There remains a need for a more economically viable and effective apparatus and method of enhancing oil and gas recovery such as those of the present invention.

BRIEF SUMMARY OF THE INVENTION

It is an object of the present invention to enhance fluid and gas flow in a well.

It is another object to improve the apparatus for enhancing fluid and gas flow in a well.

It is still another object to artificially induce optimal recovery conditions in a well, while maintaining its flow at a measurable rate.

Yet another object is to establish flow patterns which improve the promotion of fluid break up into droplets and thus prevent fluid from falling back into the well during well shut-in periods.

Accordingly, the present invention is directed to an apparatus for enhancing fluid and gas recovery in a well. The apparatus includes an upstream flow line communicably connected at one end to the well in a manner to receive fluid and gas therefrom. A fluid and gas separator communicably connects to another end of the upstream flow line in a manner to receive fluid and gas flow therefrom. A downstream sales flow line communicably connects to the fluid and gas separator in a manner to receive gas flow therefrom and having restricted region therein. A pressure differential control is operably dissociated with the downstream sales flow line for sensing pressure differential in the downstream sales flow line about the restricted region. A control valve is operably disposed in the upstream flow line and operably controllably connected to the pressure differential control in a manner to permit regulated flow through the upstream flow line at a predetermined amount in response to the sensed pressure differential. Another aspect of the invention includes the introduction of additives into the well-bore to increase recovery, wherein the additives are activated and controlled by flow patterns established therein. A benefit realized is the ability to size the injection tubing whereby it reduces the capacity in the flowing through the tubing such that a siphoning action is created.

A method of the present invention includes the steps of controllably delivering fluid and gas from a well in a single inlet flow path to a separator, separating the fluid from the gas into two separate outlet flow paths from the separator, comparatively sensing pressure of gas about a restricted region of the outflow path, and controllably regulating flow rate of the fluid and the gas in the inlet path in response to the sensed pressures and in accordance with a predetermined flow rate. Additionally, the method may include the adding of a flow enhancing additive to the well.

Other objects and advantages will be readily apparent to those skilled in the art upon viewing the drawings and reading the detailed description hereafter.

DETAILED DESCRIPTION OF THE INVENTION

Figure 1:
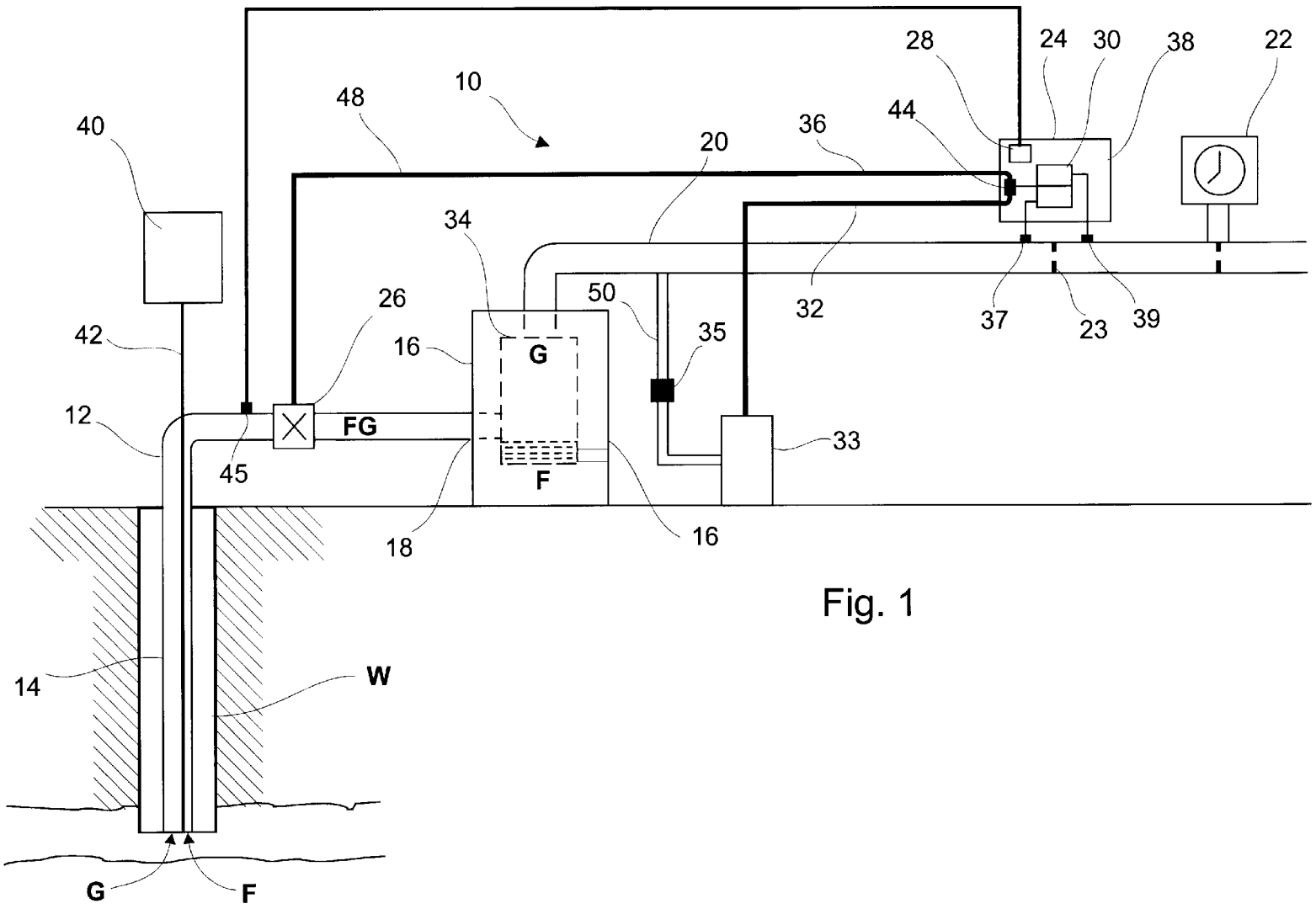
FIG. 1 is a schematic diagram of the present invention.

Referring to FIG. 1, the apparatus for enhancing fluid and gas recovery in a well W of the present invention is generally referred to by the numeral 10. The apparatus 10 includes an upstream flow line 12 communicably connected at one end 14 to the well W in a manner to receive fluid F and gas G therefrom. A fluid and gas separator 16 communicably connects to another end 18 of the upstream flow line 12 in a manner to receive fluid F and gas G flow therefrom. A downstream sales flow line 20 communicably connects to the fluid and gas separator 16 in a manner to receive gas G flow therefrom.

A gas metering device 22 of a provider is operably disposed in the downstream sales flow line 20. A restricted region or orifice 23 is formed in the downstream sales flow line 20. A pressure differential control (PDC) 24 is operably associated with the downstream sales flow line 20 between the gas metering device 22 and the fluid and gas separator 16 and is shown in one aspect for sensing pressure differential in the downstream sales flow line 20 about the orifice 23. A control valve 26 is operably disposed in the upstream flow line 12 and is operably controllably connected to the PDC 24 in a manner to permit regulated flow through the upstream flow line 12 at a predetermined amount in response to the sensed pressure differential. Optionally, the PDC 24 may include a timer device 28 which can also be used alone or in combination to control the control valve 36 to restrict and open at a predetermined time in accordance with the predetermined flow characteristics of the well W, i.e. its natural flow rate. Optionally, the PDC 24 may be connected to another pressure sensor 45 on the upstream flow line 12 which may be used in establishing the predetermined flow characteristics of the well W.

Preferably, the PDC 24 is equipped with means 30 for sensing when the pressure differential. The sensing means 30 can be mechanically or electrically based. In this regard, the sensing means 30 is operably connected to a controlled transfer valve 44 which is connected to one end 36 of a line 48 which sends a supply gas as a signal to the inlet control valve 26, for operation thereof. This supply gas emanates from a line 32 which is operably connected to a scrubber 34. The scrubber 34 is in turn operatively connected to a line 35 having a regulator 50 therein. The line 35 is operably connected to the downstream flow line 20 to receive gas therefrom. The sensing means 30, includes a pressure transducer 38 which is operably connected to the downstream sales flow line 20 having two pressure sensors 37 and 39 operably employed on the downstream flow line 20 about the orifice 23 in order to sense the amount of pressure differential about the orifice 23. The components aid to regulate the supply of gas in the downstream flow line 20.

As the PDC 24 senses pressure differentials above or below a predetermined threshold range, the PDC 24 sends a supply signal to the control valve 26 via a transfer valve 44 causing it to restrict or open accordingly. For example, when fluids F and gas G are flowing in the upstream flow line 12, and the flow of gas G decreases, then flow decreases in the downstream sales flow line 20. The PDC 24 senses the decrease in gas G flow and further opens the control valve 26. This enables fluids F and gas G to enter the separator 16 faster and reduces back-pressure in the well W which would normally cause fluids F to fall back down the well W. Without this immediate and preferably automatic opening of the control valve 26 which relieves this condition, the fluids F would begin falling back into the well W before reaching the surface. Conversely, as flow in the upstream flow line 12 increases, flow in the downstream sales flow line 20 increases which initiates the PDC 24 to actuate the control valve 66 to restrict, thus keeping the flow conditions at an optimum to lift fluids F and for a longer period and also present over-ranging the meter 22. This volume flow control keeps gas G at a rate which is not too fast or slow, but sufficient provide lift of the fluid F.

This is important in that if the proper flow rates are not maintained, the fluids tend to lay against the tubing wall and won't come to the surface. As previously stated, the natural flow rate can be determined based upon a particular well's original natural geological characteristics and this flow rate is what is ideally attempted to be maintained by the PDC 24.

Since the gas G expands as it moves toward the surface of the well W, the fluid F is necessarily drawn to the top with the gas G and the rate is necessarily a function of the gas G maintained in the fluid F. The separator 16 affects the optimal recovery by virtue of separating the gas G from the fluid F. Accordingly, an aim of the invention is to maintain an acceptable flow rate which optimally promotes fluid F and gas G flow in a manner which avoids the deleterious effects of spiking caused by restricting flow of the well W.

Additionally, chemical and biochemical additives 40 can be added to further enhance recovery production. Such additives 40 can be liquid or solid type, such as microorganisms, foaming agents or viscosity modifiers which are delivered to the bottom of the well W by a tubing 42, for example. This injection string of tubing 42 can be sized so it will displace part of the flow capacity which permits the siphoning action or critical flow rates to be created with less force in the well formation than would be required in a more productive well.

The method of the present invention includes the steps of controllably delivering fluid and gas from a well in a single inlet flow path to a separator separating the fluid from the gas into two separate outlet flow paths from the separator, comparatively sensing pressure of gas in the outflow path about a restricted region in the downstream sales flow line, and controllably regulating flow rate of the fluid and the gas in the inlet path in response to the sensed pressures and in accordance with a predetermined flow rate. Additionally, sensing pressure in the upstream flow line or timed controlling of the flow restriction can be employed to control the proper pressure for obtaining optimal flow conditions. Additionally, the method may include the adding of a flow enhancing additive to the well.

By so providing the present invention, there is realized enhanced recovery of fluid and gas. Also, the present invention provides for an enhanced method and apparatus for controlling the metered gas which is recovered.

The above described embodiment is set forth by way of example and is not for the purpose of limiting the present invention. It will be readily apparent to those skilled in the art that obvious modifications, derivations and variations can be made to the embodiments without departing from the scope of the invention. Accordingly, the claims appended hereto should be read in their full scope including any such modifications, derivations and variations.

What is claimed is:

1. An apparatus for enhancing fluid and gas flow in a well, which includes:

an upstream flow line communicably connectable at one end to the well in a manner to receive fluid and gas therefrom;

a fluid and gas separator communicably connected to another end of said upstream flow line in a manner to receive fluid and gas flow therefrom;

a downstream sales flow line communicably connected to said fluid and gas separator in a manner to receive gas flow therefrom having a restricted region therein;

a control valve operably disposed in said upstream flow line in a manner to permit regulated flow through said upstream flow line;

a pressure differential control operably associated with said downstream sales flow line for sensing pressure differential about said restricted region in said downstream sales flow line and wherein said pressure differential control actuates said control valve to cause fluid and gas to be lifted together and said pressure causing said control valve to either restrict upon sensing a pressure increase in said downstream sales flow line or open upon sensing a pressure decrease in said downstream sales flow line.

2. The apparatus of claim 1 for enhancing fluid and gas flow in a well, which includes means operably connected to said well for delivering a flow enhancing additive.

3. An apparatus for enhancing fluid and gas flow in a well, which includes:

an upstream flow line communicably connectable at one end to the well in a manner to receive fluid and gas therefrom;

a fluid and gas separator communicably connected to another end of said upstream flow line in a manner to receive fluid and gas flow therefrom;

a downstream sales flow line communicably connected to said fluid and gas separator in a manner to receive gas flow therefrom;

a control valve operably disposed in said upstream flow line to permit regulated flow through said upstream flow line; and a timing controller operably associated with said control valve to cause one of restriction and opening of said control valve at predetermined times and having means for setting predetermined times to achieve a flow rate in said upstream line in accordance with the well's natural flow rate and wherein said timer control actuates said control valve to cause fluid and gas to be lifted together and causing said control valve to either restrict upon predetermined pressure increases in said downstream sales flow line or open upon predetermined pressure decreases in said downstream sales flow line.

4. The apparatus of claim 3 for enhancing fluid and gas flow in a well, which includes means operably connected to said well for delivering a flow enhancing additive.

5. An apparatus for enhancing fluid and gas flow in a well, which includes:

an upstream flow line communicably connectable at one end to the well in a manner to receive fluid and gas therefrom;

a fluid and gas separator communicably connected to another end of said upstream flow line in a manner to receive fluid and gas flow therefrom;

a downstream sales flow line communicably connected to said fluid and gas separator in a manner to receive gas flow therefrom;

a control valve operably disposed in said upstream flow line in a manner to permit regulated flow through said upstream flow line; and a pressure differential control operably associated with said downstream sales flow line for sensing pressure differential between said upstream flow line and said downstream sales flow line and wherein said pressure differential control actuates said control valve to cause fluid and gas to be lifted together and said pressure differential control causing said control valve to either restrict upon sensing a pressure increase in said downstream sales flow line or open upon sensing a pressure decrease in said downstream sales flow line.

6. The apparatus of claim 5 for enhancing fluid and gas flow in a well, which includes means operably connected to said well for delivering a flow enhancing additive.

7. A method of enhancing recovery in a well, which includes the steps of:

(a) controllably delivering fluid and gas from a well in a single inlet flow path to a separator;

(b) separating said fluid from said gas into two separate outlet flow paths from said separator; and (c) controllably regulating flow rate of said fluid and said gas in said inlet path in accordance with at least one of predetermined times, outlet flow path to inlet path pressure ratios, varying pressures in said outlet flow paths and a predetermined flow rate.

8. The method of claim 7, which further includes the step of (d) comparatively sensing flow rates of gas in said outflow path to said time and pressure in said inlet flow paths and the step (c) is further characterized to be controllably regulating flow rates of said fluid and said gas in said inlet in response to said sensed rates.

9. The method of claim 7, wherein the step (c) is further characterized to be controllably regulating the flow rate of said fluid and said gas in said inlet path at predetermined times based upon predetermined natural flow rates.

10. The method of claim 7, which further includes the step of adding of a flow enhancing additive to said well.

11. The method of claim 7, which further includes the step of (d) comparatively sensing the flow rates in said out flow path about a restricted region therein.

* * * * *